US011262054B1

(12) United States Patent
Melamed

(10) Patent No.: US 11,262,054 B1
(45) Date of Patent: Mar. 1, 2022

(54) COMPACT LIGHT DEVICE

(71) Applicant: Hardeep Melamed, Atlanta, GA (US)

(72) Inventor: Hardeep Melamed, Atlanta, GA (US)

(73) Assignee: LOTTA-LITE, LLC, Atlanta, GA (US)

( * ) Notice: Subject to any disclaimer, the term of this patent is extended or adjusted under 35 U.S.C. 154(b) by 0 days.

(21) Appl. No.: 17/063,199

(22) Filed: Oct. 5, 2020

(51) Int. Cl.

| | |
|---|---|
| ***F21V 21/088*** | (2006.01) |
| ***F21L 4/00*** | (2006.01) |
| ***F21V 23/04*** | (2006.01) |
| *F21Y 115/10* | (2016.01) |

(52) U.S. Cl.
CPC ..... *F21V 21/0885* (2013.01); *F21L 4/00* (2013.01); *F21V 23/04* (2013.01); *F21Y 2115/10* (2016.08)

(58) Field of Classification Search
CPC ..... F21V 21/0885; F21V 23/04; F21L 4/00
See application file for complete search history.

(56) References Cited

U.S. PATENT DOCUMENTS

2006/0087833 A1* 4/2006 Simoni ..... F21V 21/30 362/103
2010/0289433 A1* 11/2010 Lau ..... H05B 45/30 315/313
2012/0318985 A1* 12/2012 Bushee ..... A01K 27/006 250/342
2015/0267902 A1* 9/2015 Zhang ..... F21L 4/04 362/188
2016/0025295 A1* 1/2016 Merrow ..... F21V 7/24 362/158

* cited by examiner

*Primary Examiner* — Rajarshi Chakraborty
*Assistant Examiner* — Nathaniel J Lee
(74) *Attorney, Agent, or Firm* — Malloy & Malloy, P.L.; Robert M. Downey

(57) ABSTRACT

A compact light device includes a housing containing an integrated circuit board having a number of components thereon including at least one high CRI LED, a timer for controlling illumination time of the LED, and a switch for activating illumination of the at least one LED. A front face of the housing has openings for receiving lens covers for each LED and an actuator button for operating the switch on the circuit board. A removable spring biased clip allows the light device to be conveniently attached and removed from all types of articles and objects. A battery drawer slides out from the housing to allow replacement of batteries used for powering the components on the circuit board. One or more adhesive pads on the bottom of the housing enable mounting of the light device to any flat surface.

12 Claims, 5 Drawing Sheets

COMPACT LIGHT DEVICE

BACKGROUND OF THE INVENTION

Field of the Invention

The present invention relates to compact light devices and, more particularly, to a compact light device that uses one or more high CRI LEDs that are activated for a predetermined time and wherein the compact light device includes a removable clip and one or more adhesive membranes (i.e., pads) on the bottom side to allow for attachment and removal of the compact light device to virtually any article, object and/or surface, and further wherein the compact light device may be attached to a keychain, lanyard, necklace or other member that allows the light device to hang.

Description of the Related Art

Compact light devices of various types are well-known in the art. For instance, flashlights of all different types and sizes are well-known and can be made to be carried in a pocket, on a keychain or other article. Notwithstanding, there remains a need for a compact light device that provides for ease of attachment and removal to all types of articles, objects and/or surfaces such as, but not limited to, the inside of a purse or makeup bag, the inside of a gym bag or tote bag, inside of a tool box, within a locker, for use as a nightlight or to read a menu in dark places, and further wherein the device can be attached to a necklace, a keychain or other lanyard. Moreover, the various compact light devices in the prior art fail to provide for a timer that allows the compact light device to remain illuminated for a preset amount of time, and to thereafter turn off so that the battery power is conserved, particularly in the instance that the user may forget to turn off the light device after use.

Accordingly, there is a need for a compact light device that allows for ease of removal and attachment to all types of articles, objects and surfaces, such as those noted above. Moreover, there is a need for a compact light device that is stylish and which provides for excellent illumination properties with the use of one or more CRI LEDs, and further wherein the light device may include a timer for controlling illumination time of the LED so that the one or more LEDs turn off after a preset time period, thereby conserving battery power.

SUMMARY OF THE INVENTION

The present invention is directed to a compact light device that is particularly adapted for removal and attachment to all types of articles, objects and/or surfaces. The compact light device includes a housing having an upper portion with a front face and a lower portion with a bottom side. An integrated circuit board is contained within the housing and has a number of components thereon, including at least one high CRI LED, a timer for controlling the illumination time of the at least one LED after activation, and a switch for activating illumination of the at least one LED. In a preferred embodiment, the compact light device includes two high CRI LEDs on the circuit board. The LEDs are positioned to emit light from the front face through LED lens covers. An actuator button on the front face operates the switch on the circuit board to thereby activate illumination of the LEDs throughout the timed sequence of operation, as controlled by the timer. In a preferred embodiment, the two LED lens covers and the actuator button are shaped and arranged on the front face of the housing of the compact light device to present the appearance of a face, including two eyes and a mouth.

A removable spring biased clip is received within a track structure on the bottom side of the housing and allows the compact light device to be conveniently attached and removed from all types of articles and objects such as, but not limited to, a purse or handbag, a makeup bag, a pocket, a tote bag, etc. A battery drawer, for holding one or more batteries, slides out from the housing to allow replacement of the batteries used for powering the components on the circuit board. One or more adhesive pads on the bottom side of the housing allow for mounting of the compact light device to virtually any flat surface.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Referring to the several views of the drawings, the compact light device of the present invention is shown and is generally indicated as 10.

Figure 2:
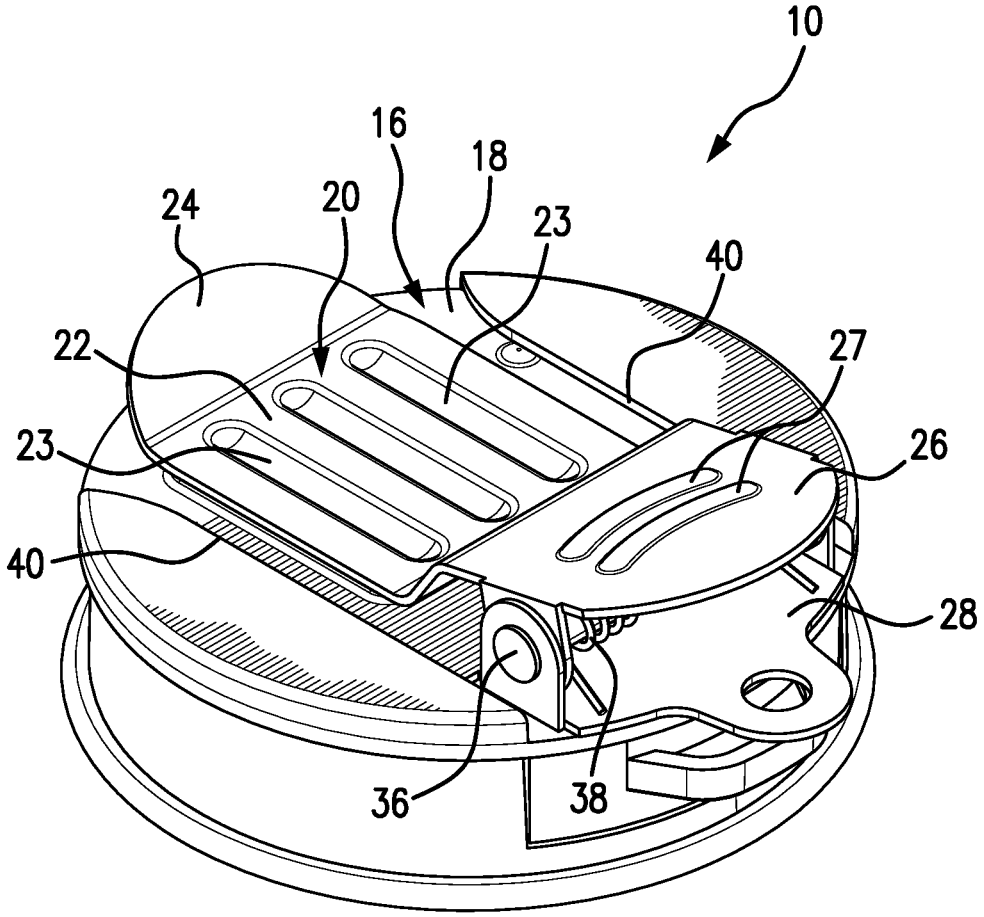
FIG. 2 is a bottom perspective view of the compact light device of FIG. 1.

The compact light device 10 includes an outer casing or housing having a top portion 12 with a front face 14 and a bottom portion 16 with a bottom side 18. A clamp is fitted to the bottom side 18 to allow the compact light device 10 to be conveniently attached to all types of objects and articles such as, but not limited to, the interior of a woman's purse, a makeup bag, gym bags, tote bags, pockets on clothing, a sun visor in an automobile, etc. The clamp 20 includes a base plate 28 having an arrangement of open slots formed therethrough and an extending tab 30 with a hole 32 formed therethrough that allows convenient attachment of the clamp and attached compact light device to a keychain, necklace, lanyard or other member that allows the compact light device to hang. The clamp 20 further includes a clamping plate 22 maintained in opposing relation to the base plate 28. The clamping plate 22 includes open slots 23, along with an upwardly angled distal end portion 24 that promotes passage of an article, such as a pocket, fabric or other member between the base plate 28 and the clamping plate 22 of the clamp 20. The clamping plate 22 further includes a pressure application portion 26, opposite the distal end portion 24. The pressure application portion 26 includes grip members 27 thereon for applying pressure to the pressure application portion 26 in order to urge the clamping plate 22 away from the base plate, as described hereinafter. The base plate 28 and the clamping plate 22 are pivotally fitted to one another by a pivot pin or axle 36 that extends through aligned ear portions on opposite sides of both the pressure application portion 26 and the base plate 28, as best seen in FIG. 2. A spring 38 is fitted about the axle 36 to urge the clamping plate 22 against the base plate 28 when in a normal state. When pressure is applied to the pressure application portion 26, and particularly on the grip members 27, the clamping plate 22 is urged against the force of the spring 38 and away from the base plate 28, to thereby allow passage of an article of attachment between the base plate 28 and the clamping plate 22 of the clamp 20, thereby attaching the clamp 20 and compact light device 10 to the particular article (e.g., the inside of a purse, makeup bag, gym bag, tote bag, pocket, sun visor, etc.). The clamp 20 is removably secured to the bottom 18 of the housing of the compact light device 10 within a track formed by raised portions 40 on opposing sides of the clamp, as seen in FIG. 2. Specifically, a gap between the raised portions 40 and the bottom side 18 of the housing of the compact light device allows side portions 34 of the base plate 28 to slide under the raised portions 40 and into secured, removable attachment to the housing of the compact light device.

Figure 3:
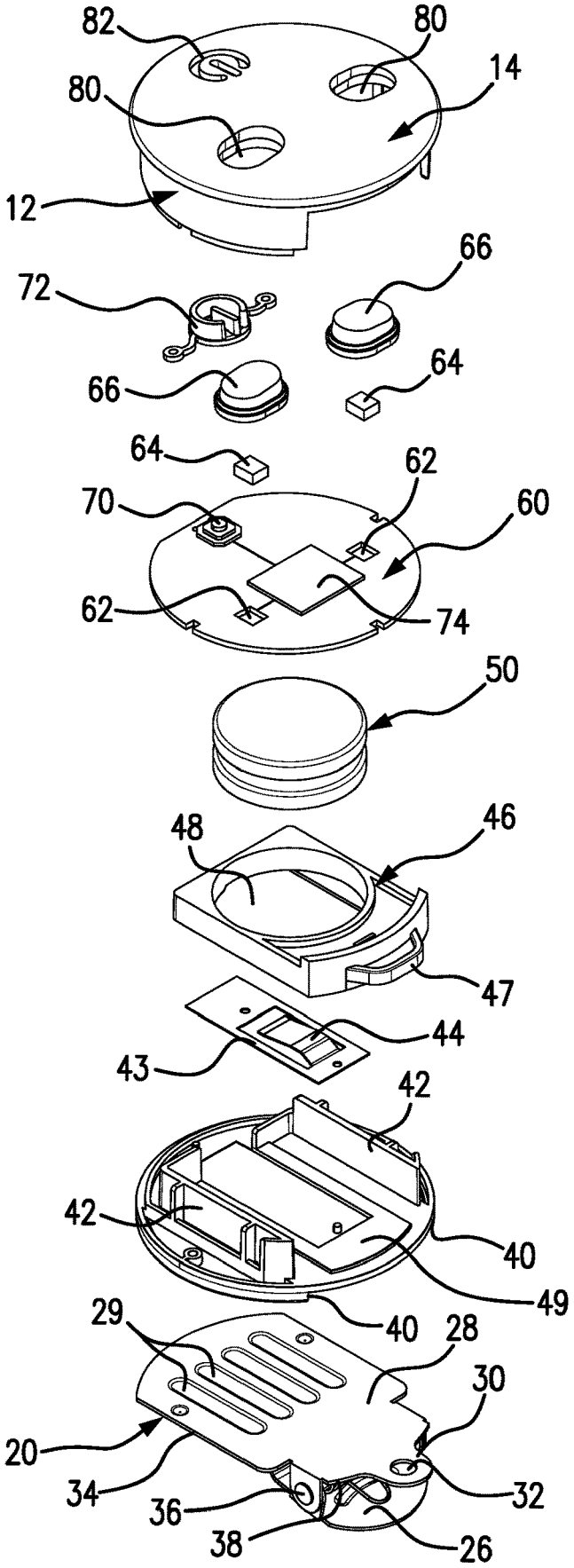
FIG. 3 is an exploded perspective view showing the individual components and parts of the compact light device.

Referring to FIG. 3, the bottom portion of the housing includes a battery compartment that is surrounded by vertical walls 42 and an opening in the side of the housing. A battery contact plate 43 is fitted to the inner surface of the bottom of the housing, between the vertical walls 42, within the battery compartment. The battery contact plate 43 includes a leaf spring contact 44 for electrical contact with the battery terminal. A battery drawer 46 is received within the battery compartment, through the opening in the side of the housing, and is guided on a track 49 between the vertical walls 42. The drawer includes a handle 47 to allow the drawer to be pulled out from the battery compartment, on the guide track 49, to thereby allow removal and replacement of batteries 50. The batteries 50 are received within an opening 48 in the drawer 46. When the batteries 50 are received within the opening 48 of the drawer 46 and the drawer is closed (i.e., moved back into the battery compartment), the contact plate 43, and particularly the leaf spring contact 44, makes electrical contact with the terminal of the lowermost battery 50 within the drawer.

Still referring to FIG. 3, an integrated circuit board 60 is contained within the housing and contains a number of electric components thereon including at least one high CRI LED. In the preferred embodiment, as seen in FIG. 3, two high CRI LEDs 64 are carried on the circuit board 60 at locations 62. When fully assembled, the LEDs 64 are covered by lens covers 66 that are fitted within openings 80 on the front face 14 of the top portion 12 of the housing. A switch 70 is mounted on the circuit board 60 for activating illumination of the LEDs. In a preferred embodiment, the switch 70 is a spring button switch that is operated between an on and off state by applying pressure and releasing pressure from the button switch. The circuit board 60 further includes a timer 74 thereon for controlling illumination of the LEDs 64 throughout a timed sequence. In a preferred embodiment, the timer 74 is structured to deactivate illumination of the LEDs after 60 seconds. This timed sequence of operation of the LEDs, as controlled by the timer 74, can be programmed during manufacture. Alternatively, the circuit board can be programmed to allow for changes in the timed activation sequence of the timer 74. An actuator button 72, fitted through opening 82 in the front face 14 of the top portion 12 of the housing is positioned and disposed in direct contact with the switch 70 on the circuit board 60. Upon pressing down (i.e., depressing) the actuator button 72, the switch 70 is operated between the on and off states.

Figure 1:
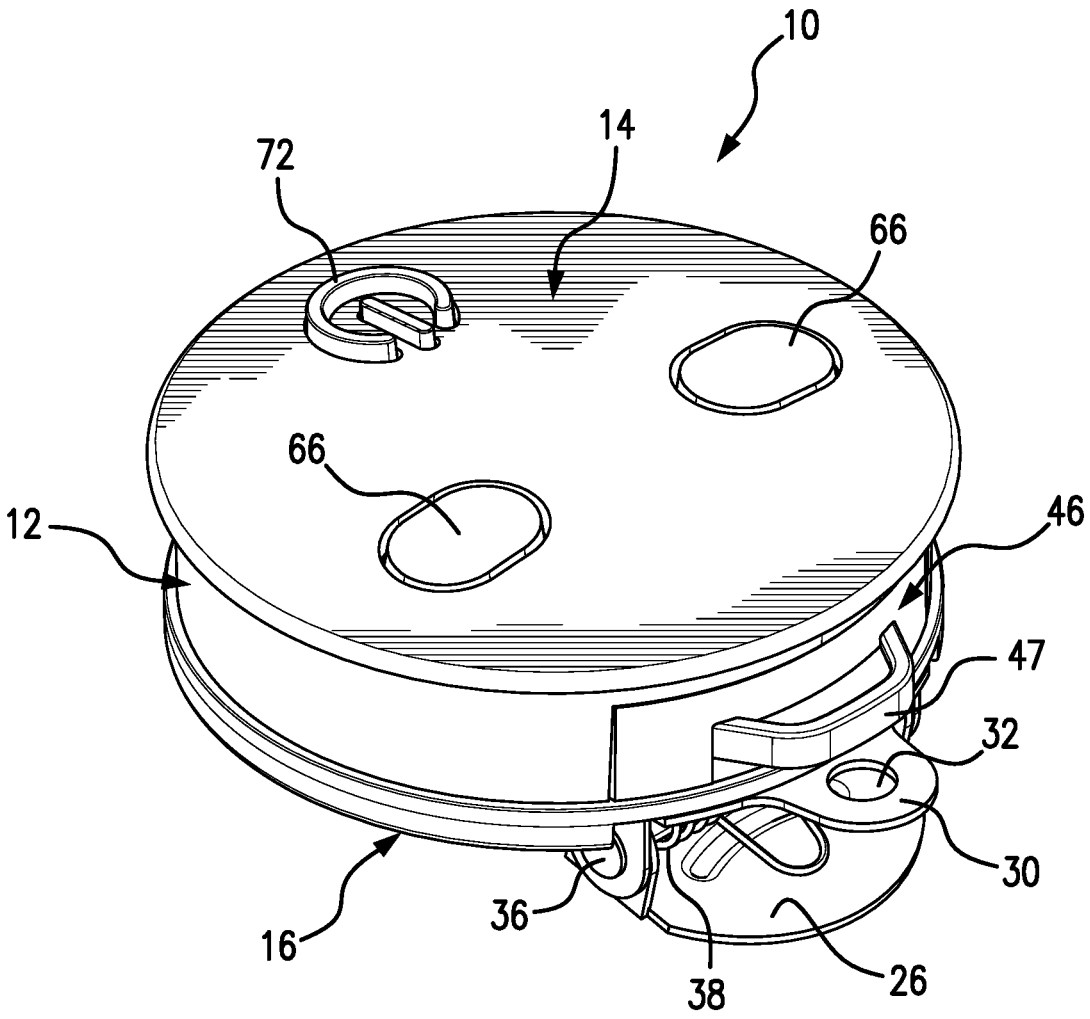
FIG. 1 is a top perspective view of the compact light device of the present invention in accordance with a preferred embodiment thereof.
Figure 4:
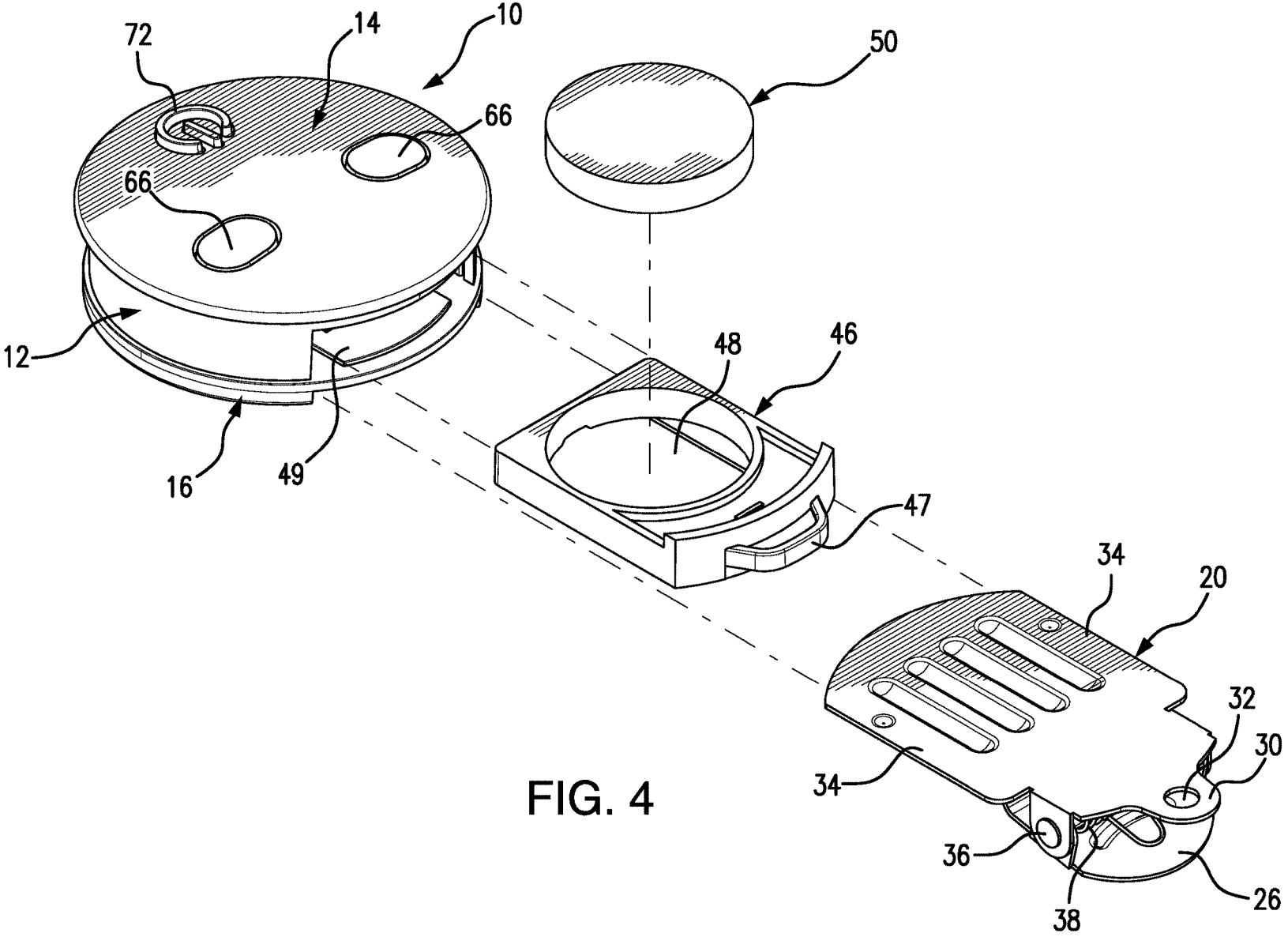
FIG. 4 is an exploded perspective view showing a spring operated clip removed from a holding track on the bottom of the housing and a battery drawer removed from the battery compartment of the housing.

As seen in FIGS. 1 and 4, the LED lens covers 66 and the actuator button 72 are arranged to form a face including two eyes and a mouth. The actuator button 72 may be viewed to also represent the image of a nose created by the straight portion extending between the open curved portion of the actuator button 72.

Figure 5:
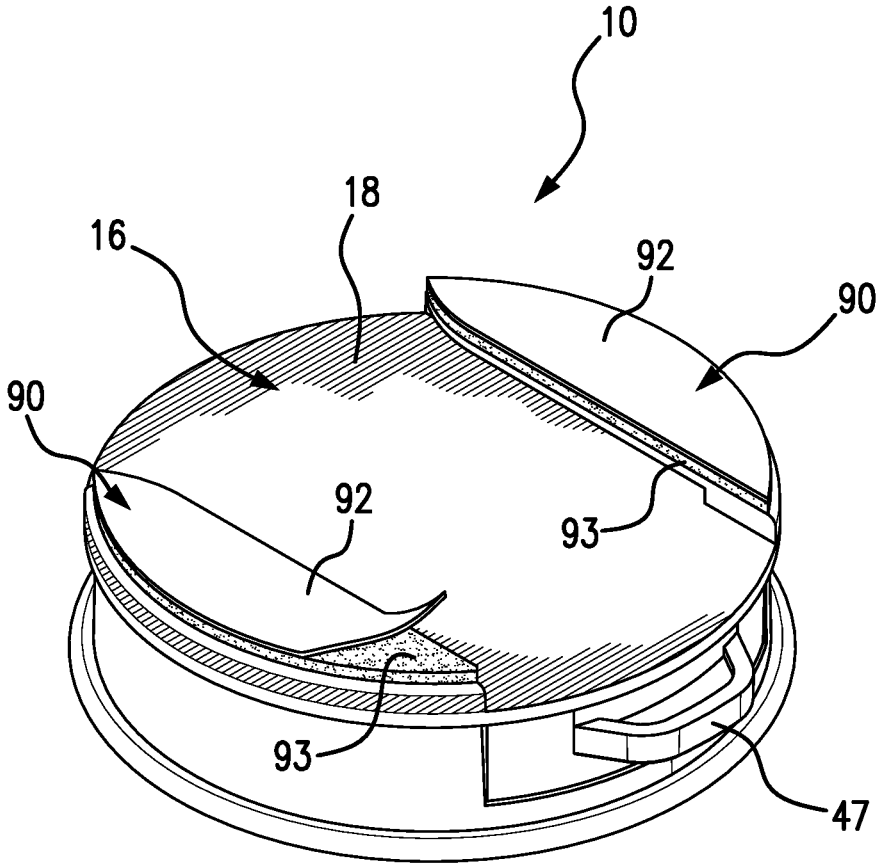
FIG. 5 is a bottom perspective view of the compact light device of FIG. 1, shown with the spring operated clip removed and adhesive pads on the bottom for allowing selective mounting of the light device to a surface.

Referring to FIG. 5, the compact light device 10 is shown with the clip removed to allow attachment of the compact light device to virtually any flat surface with the use of double-sided adhesive tape or pads 90. As seen in FIG. 5, the double-sided adhesive pads 90 are adhered to the raised portions 40 on the bottom of the housing. By removing a protective film 92 from the adhesive pads, a tacky adhesive surface 93 is revealed to allow the compact light device to be easily pressed against and adhered to virtually any surface such as, for example, the underside of cabinets, inside of a locker, above a work bench, the underside cover of a toolbox, a wall surface, or virtually any other surface where it is desired to have a light. The compact light device can thereafter be removed from the surface and the clip 20 can be reattached for use on other objects and articles, such as within a purse, makeup bag, gym bag or tote bag. As previously mentioned, the compact light device can also be carried on a keychain, necklace, lanyard or other cord or chain, as desired by the user.

It is important to note that the compact light device of the present invention is specifically designed to essentially be a light that can be taken anywhere, for use in all types of situations and environments. The compact light device can be carried by the user in a pocket, purse or other bag, or fixed to various surfaces, as noted above. Moreover, the compact light device can be hung on a keychain, necklace or on any type of chain or lanyard for all types of purposes, as desired by the user. The timer 74 feature of the light is convenient to conserve battery power in the event the user forgets to turn the LED lights off after use. However, it is contemplated that for situations where extended use may be desired, such as under a cabinet for countertop lighting, or at a work bench, the timer 74 function can be disabled by the user.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A compact light device comprising:

a housing having a front face and a back and at least one side wall between the front face and the back;

an integrated circuit board contained and enclosed within the housing between the front face and the back, and the circuit board having a plurality of components thereon including at least one LED, a timer for programmably controlling illumination time of the at least one LED throughout a timed activation sequence, and a switch for activating illumination of the at least one LED;

an actuator button protruding from the front face and in operative engagement with the switch on the integrated circuit board, and the actuator button being structured and disposed for operating the switch on the circuit board by depressing the actuator button;

a lens cover fitted within an opening on the front face and covering the at least one LED;

a spring biased clip removably attachable on the back of the housing, and the spring biased clip being structured and disposed for attaching and removing the compact light device from any of a plurality of select articles and objects;

at least one raised portion on the back of the housing and adjacent to the spring biased clip, and the at least one raised portion including an adhesive member thereon for attaching the housing to a mounting surface; and a battery compartment for containing at least one battery for supplying electric power to the components on the circuit board.

2. The compact light device as recited in claim 1 wherein the back of the housing includes a track formed therein for allowing sliding attachment and removal of the spring biased clip from the housing.

3. The compact light device as recited in claim 1 further including a plurality of LEDs on the integrated circuit board.

4. The compact light device as recited in claim 3 wherein the front face of the housing includes a plurality of openings for alignment with the plurality of LEDs, thereby allowing light to be emitted from the plurality of LEDs and out from the front face of the housing.

5. The compact light device as recited in claim 1 wherein the compact light device is structured and disposed for hanging on an elongate lanyard.

6. The compact light device as recited in claim 5 wherein the elongate lanyard is a chain.

7. The compact light device as recited in claim 5 wherein the elongate lanyard is a necklace.

8. The compact light device as recited in claim 5 wherein the spring biased clip includes an aperture formed therein for attachment of the elongate lanyard thereto.

9. A compact light device comprising:

a housing having a front face and a back and at least one side wall between the front face and the back;

an integrated circuit board contained and enclosed within the housing between the front face and the back, and the circuit board having a plurality of components thereon;

the plurality of components on the integrated circuit board including at least one LED;

the plurality of components on the integrated circuit board further including a programmable timer for controlling illumination time of the at least one LED throughout a timed activation sequence;

the plurality of components on the integrated circuit board further including a switch for activating illumination of the at least one LED;

an actuator button protruding from the front face and in operative engagement with the switch on the integrated circuit board, and the actuator button being structured and disposed for operating the switch on the circuit board by depressing the actuator button;

a spring biased clip removably attachable on the back of the housing, and the spring biased clip being structured and disposed for attaching and removing the compact light device from any of a plurality of select articles and objects;

a track formed in the back of the housing for allowing sliding attachment and removal of the spring biased clip from the housing;

at least one raised portion adjacent to the track and having an adhesive member thereon for attaching the housing to a mounting surface; and a battery compartment for containing at least one battery for supplying electric power to the components on the circuit board.

10. The compact light device as recited in claim 9 further including a plurality of LEDs on the integrated circuit board.

11. The compact light device as recited in claim 10 wherein the front face of the housing includes a plurality of openings for alignment with the plurality of LEDs, thereby allowing light to be emitted from the plurality of LEDs and out from the front face of the housing.

12. A compact light device comprising:

a housing having a front face and a back and at least one side wall between the front face and the back;

an integrated circuit board contained and enclosed within the housing between the front face and the back, and the circuit board having a plurality of components thereon;

the plurality of components on the integrated circuit board including a plurality of LEDs;

the plurality of components on the integrated circuit board further including a programmable timer for controlling illumination time of the plurality of LEDs throughout a timed activation sequence;

the plurality of components on the integrated circuit board further including a switch for activating illumination of the plurality of LEDs;

the front face of the housing including a plurality of openings for alignment with the plurality of LEDs, thereby allowing light to be emitted from the plurality of LEDs and out from the front face of the housing;

a plurality of lens covers fitted within the plurality of openings in the front face of the housing for covering the plurality of LEDs;

an actuator button protruding from the front face and in operative engagement with the switch on the integrated circuit board, and the actuator button being structured and disposed for operating the switch on the circuit board by depressing the actuator button;

a spring biased clip removably attachable on the back of the housing, and the spring biased clip being structured and disposed for attaching and removing the compact light device from any of a plurality of select articles and objects;

a track formed in the back of the housing for allowing sliding attachment and removal of the spring biased clip from the housing;

at least one raised portion adjacent to the track and having an adhesive member thereon for attaching the housing to a mounting surface; and a battery compartment for containing at least one battery for supplying electric power to the components on the circuit board.

* * * * *